US006287360B1

(12) United States Patent
Kembaiyan et al.

(10) Patent No.: US 6,287,360 B1
(45) Date of Patent: Sep. 11, 2001

(54) HIGH-STRENGTH MATRIX BODY

(75) Inventors: Kuttaripalayam T. Kembaiyan; Thomas W. Oldham, both of The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/156,852

(22) Filed: Sep. 18, 1998

(51) Int. Cl.[7] ..... B24D 3/02

(52) U.S. Cl. ..... 75/240; 419/15; 419/18; 175/374

(58) Field of Search ..... 419/15, 18; 75/240; 175/374

(56) References Cited

U.S. PATENT DOCUMENTS

| | | | | |
|---|---|---|---|---|
| 3,850,614 | | 11/1974 | Bleecker | 75/5 BB |
| 4,066,451 | * | 1/1978 | Rudy | 75/240 |
| 5,090,491 | | 2/1992 | Tibbitts et al. | 175/409 |
| 5,281,260 | | 1/1994 | Kumar et al. | 75/240 |
| 5,541,006 | * | 7/1996 | Conley | 428/552 |
| 5,589,268 | | 12/1996 | Kelley et al. | 428/408 |
| 5,662,183 | | 9/1997 | Fang | 175/374 |
| 5,733,664 | * | 3/1998 | Kelley et al. | 428/457 |
| 5,944,127 | * | 8/1999 | Liang et al. | 175/374 |

* cited by examiner

*Primary Examiner*—Daniel J. Jenkins
(74) *Attorney, Agent, or Firm*—Rosenthal & Osha L.L.P.

(57) ABSTRACT

A new composition for making an improved high-strength matrix body and methods of making the matrix body are disclosed. The new composition includes large-grain carburized tungsten carbide, an infiltration binder, and optionally cast tungsten carbide. The high-strength matrix body is formed from the new composition by an infiltration process. Suitable infiltration binders include all transition metals and all main group metals. To obtain optimal physical properties, large-grain carburized tungsten carbide is mixed with cast tungsten carbide and Ni powder before infiltration. The high-strength matrix body has improved braze strength. Such matrix bodies are suitable for manufacturing bit bodies for PDC drill bits and other earth-boring devices.

48 Claims, 7 Drawing Sheets

HIGH-STRENGTH MATRIX BODY

FIELD OF THE INVENTION

This invention relates generally to a composition for the matrix body of rock bits and other cutting or drilling tools.

BACKGROUND OF THE INVENTION

Polycrystalline diamond compact ("PDC") cutters have been utilized in earth-boring drill bits. Typically, PDC bits include an integral bit body which may be made of steel or fabricated of a hard matrix material such as tungsten carbide (WC). A plurality of diamond cutter devices, e.g., PDC cutters, are mounted along the exterior face of the bit body. Each diamond cutter has a stud portion which typically is brazed in a recess or pocket in the exterior face of the bit body.

The PDC cutters are positioned along the leading edges of the bit body so that, as the bit body is rotated in its intended direction of use, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure and loss of one or more of the PDC cutters.

While steel body bits have toughness and ductility properties which render them resistant to cracking and failure due to impact forces generated during drilling, steel is more susceptible to erosive wear caused by high-velocity drilling fluids and formation fluids which carry abrasive particles, such as sand, rock cuttings, etc. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off or wear, revealing the softer steel body which is then rapidly eroded. This can lead to loss of PDC cutters as the area around the cutter is eroded away, causing the bit to fail.

Tungsten carbide or other hard metal matrix body bits have the advantage of higher wear and erosion resistance. The matrix bit generally is formed by packing a graphite mold with tungsten carbide powder and then infiltrating the powder with a molten copper-based alloy binder. For example, macro-crystalline tungsten carbide and cast tungsten carbide have been used to fabricate the bit body. Macro-crystalline tungsten carbide is essentially stoichiometric WC which is, for the most part, in the form of single crystals. Some large crystals of macro-crystalline WC are bi-crystals. Cast tungsten carbide, on the other hand, is a eutectic two-phase carbide composed of WC and $W_2C$. There can be a continuous range of compositions therebetween. Cast tungsten carbide typically is frozen from the molten state and comminuted to a desired particle size.

However, a bit body formed of the aforementioned tungsten carbide or other hard metal matrix materials may be brittle and may crack upon being subjected to impact and fatigue forces encountered during drilling. Additionally, the braze joints between the matrix material and the PDC cutters may crack due to these forces. The formation and propagation of cracks in the matrix body and at the braze joints may result in the loss of one or more PDC cutters. A lost cutter may abrade against the bit, causing further accelerated bit damage.

For the foregoing reasons, there is a need for a new matrix-body composition for drill bits which offers improved ability to retain cutters while maintaining other desired properties, such as toughness, impact strength and wear resistance.

SUMMARY OF THE INVENTION

In one aspect, the invention relates to a new composition for forming a matrix body which includes large-grain carburized tungsten carbide and an infiltration binder including one or more metals or alloys. In some embodiments, the new composition may include a Group VIIIB metal selected from one of Ni, Co, Fe, and alloys thereof. Moreover, it may further include cast tungsten carbide.

In another aspect, the invention relates to a high-strength matrix body manufactured by the method which includes: 1) providing a composition including large-grain carburized tungsten carbide; and 2) infiltrating the composition by an infiltration binder including one or more metals or alloys. In some embodiments, the composition may include a Group VIIIB metal selected from one of Ni, Co, Fe and alloys thereof. Moreover, the composition may further includes cast tungsten carbide. In some embodiments, the composition may include, before infiltration, the large-grain carburized tungsten carbide in an amount of about 62% by weight, the cast tungsten carbide in an amount of about 30% by weight, and Ni in an amount of about 8% by weight. In other embodiments, the large-grain carburized tungsten carbide has an average particle size exceeding approximately 10 $\mu$m before infiltration.

In one aspect, the invention relates to an earth-boring bit which includes 1) a body formed from a composition including large-grain carburized tungsten carbide and a Group VIIIB metal selected from one of Ni, Co, Fe, and alloys thereof, and 2) a cutter which is fixedly attached to the body. The body is formed by infiltrating the composition by an infiltration binder that includes one or more transition metals or alloys thereof. In some embodiments, the composition may further include cast tungsten carbide. In other embodiments, the composition includes, before infiltration, the large-grain carburized tungsten carbide in an amount of about 62% by weight, the cast tungsten carbide in an amount of about 30% by weight, and Ni in an amount of about 8% by weight. In some embodiments, the cutter may be formed of carbide or cemented tungsten carbide. In other embodiments, the cutter may include a polycrystalline diamond compact or a polycrystalline cubic boron nitride compact.

In another aspect, the invention relates to a polycrystalline diamond compact bit which includes 1) a body with a lower end having a face; 2) a plurality of pockets in the face of the body; and 3) a plurality of polycrystalline diamond cutters in the pockets. The body is formed from a composition by infiltrating the composition by an infiltration binder including one or more transition metals or alloys thereof The composition includes large-grain carburized tungsten carbide and a Group VIIIB metal selected from one of Ni, Co, Fe, and alloys thereof In some embodiments, the composition may further include cast tungsten carbide. In other embodiments, the composition includes, before infiltration, the large-grain carburized tungsten carbide in an amount of about 62% by weight, the cast tungsten carbide in an amount of about 30% by weight, and Ni in an amount of about 8% by weight.

In one aspect, the invention relates to an impregnated bit which includes 1) a bit body support; 2) a matrix body attached to the bit body support; and 3) a particle of superhard material bonded in the matrix body. The matrix body is formed from a composition by infiltrating the composition by an infiltration binder including one or more transition metals or alloys thereof. The composition includes large-grain carburized tungsten carbide and a Group VIIIB metal selected from one of Ni, Co, Fe, and alloys thereof.

In another aspect, the invention relates to a method of making a high-strength matrix body. The method includes 1) providing a composition including large-grain carburized tungsten carbide; and 2) infiltrating the composition by an infiltration binder including one or more metals or alloys thereof In some embodiments, the composition may include a Group VIIIB metal selected from one of Ni, Co, Fe, and alloys thereof. The composition may further include cast tungsten carbide. In other embodiments, the composition includes, before infiltration, the large-grain carburized tungsten carbide in an amount of about 62% by weight, the cast tungsten carbide in an amount of about 30% by weight, and Ni in an amount of about 8% by weight.

In one aspect, the invention relates to a method of making an earth-boring bit. The method includes 1) providing a composition including large-grain carburized tungsten carbide and a Group VIIIB metal selected from one of Ni, Co, Fe, and alloys thereof, 2) forming a matrix body from the composition by infiltrating the composition by an infiltration binder including one or more transition metals or alloys thereof; and 3) attaching a cutter fixedly to the matrix body. In some embodiments, the composition may further include cast tungsten carbide. In other embodiments, the composition includes, before infiltration, the large-grain carburized tungsten carbide in an amount of about 62% by weight, the cast tungsten carbide in an amount of about 30% by weight, and Ni in an amount of about 8% by weight.

In another aspect, the invention relates to a method of making a polycrystalline diamond compact bit. The method includes 1) providing a composition including large-grain carburized tungsten carbide and a Group VIIIB metal selected from one of Ni, Co, Fe, and alloys thereof; 2) forming a matrix body with a lower end having a face by infiltrating the composition by an infiltration binder including one or more transition metals or alloys thereof; 3) forming a plurality of pockets in the face of the matrix body; and 4) placing a plurality of polycrystalline diamond cutters in the pockets. In some embodiments, the composition may include cast tungsten carbide. In other embodiments, the composition includes, before infiltration, the large-grain carburized tungsten carbide in an amount of about 62% by weight, the cast tungsten carbide in an amount of about 30% by weight, and Ni in an amount of about 8% by weight.

In one aspect, the invention relates to a method of making an impregnated bit. The method includes 1) providing a bit body support; 2) forming a matrix body by infiltrating a composition by an infiltration binder; and 3) attaching the matrix body to the bit body support. The composition includes large-grain carburized tungsten carbide and a Group VIIIB metal selected from one of Ni, Co, Fe, and alloys thereof, and the infiltration binder includes one or more transition metals or alloys thereof. Moreover, the matrix body includes a particle of superhard material embedded therein.

In another aspect, the invention relates to a method of drilling a wellbore. The method includes 1) providing an earth-boring bit having a matrix body and a cutter fixedly attached thereto; and 2) contacting the earth-boring bit with an earthen formation to drill a wellbore. The matrix body is formed from a composition by infiltrating the composition by an infiltration binder. The composition includes large-grain carburized tungsten carbide and a Group VIIIB metal selected from one of Ni, Co, Fe, and alloys thereof, and the infiltration binder includes one or more transition metals or alloys thereof.

DETAILED DESCRIPTION OF PREFERRED EMBODIMENTS

Figure 1:
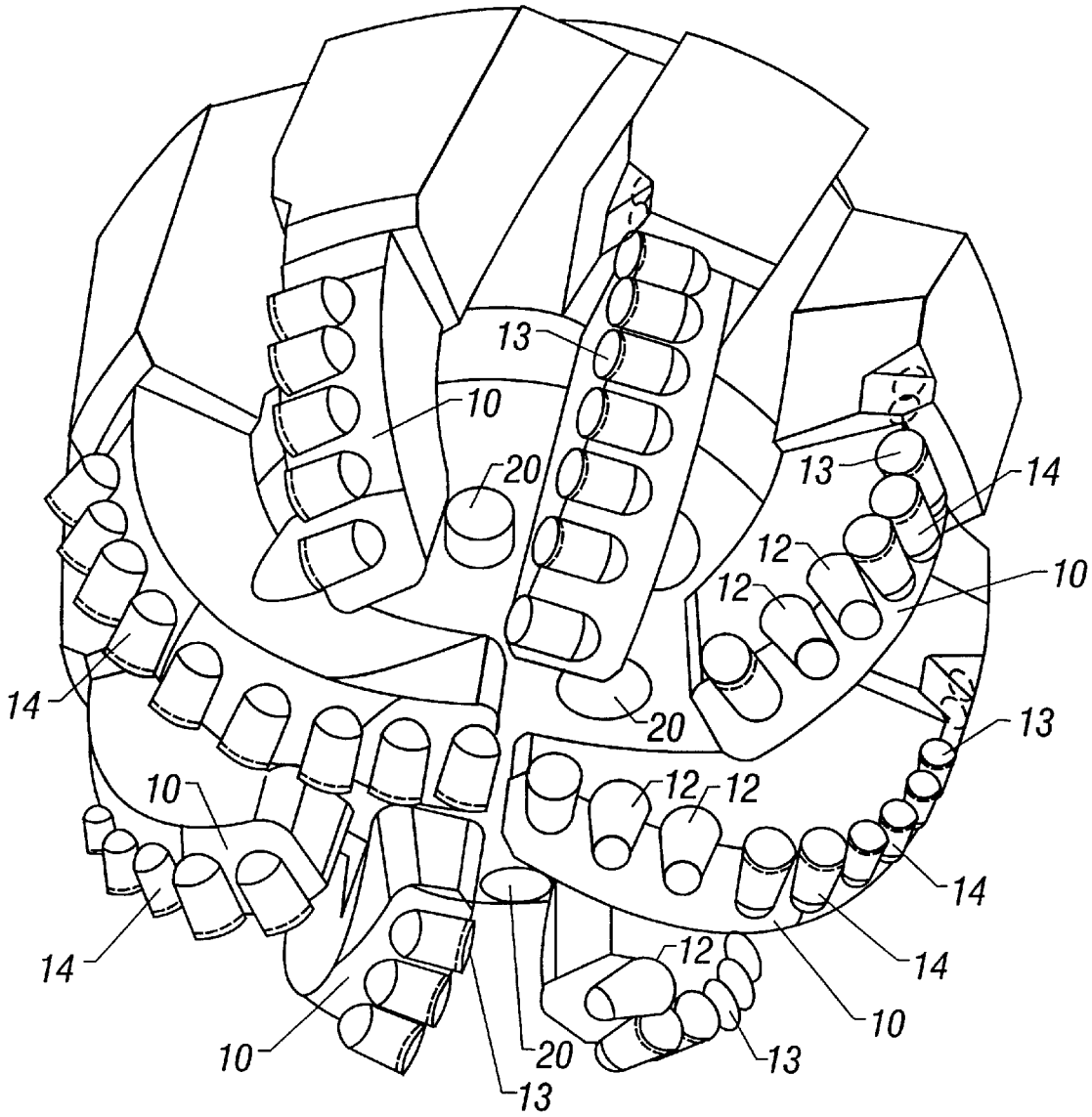
FIG. 1 is a perspective view of an earth-boring PDC drill bit body with some cutters in place according to an embodiment of the invention.

The invention is based, in part, on the realization that the braze strength of the matrix body of a fixed cutter bit plays a critical role in determining the life of such a bit. The ability of a matrix bit body to retain a cutter is measured by its braze strength, which is highly influenced by the strength and integrity of the matrix body. Typically, cracks occur where the PDC cutters are secured to the matrix body or at the base of extensions (which are called "blades"). If a matrix bit body does not provide sufficient braze strength, the PDC cutters may be sheared from the drill bit body and the expensive PDC cutters may be lost. In addition to high braze strength, a matrix body also should possess desired toughness, impact strength, and erosion resistance.

Embodiments of the invention provide a high-strength matrix body which is formed from a new composition that includes large-grain carburized tungsten carbide infiltrated by a suitable metal or alloy as an infiltration binder. Such a matrix body has high braze strength while maintaining desired toughness, impact strength and erosion resistance.

The large-grain carburized tungsten carbide used in embodiments of the invention refers to carburized tungsten carbide grains or particles exceeding ten microns (10 $\mu$m) in size. However, suitable large-grain carburized tungsten carbide may include some carburized tungsten carbide particles or grains of less than 10 $\mu$m so long as a substantial percentage of the tungsten carbide grains or particles exceed 10 $\mu$m. Here, "substantial percentage" means 50% or more. The average grain size of suitable large-grain carburized tungsten carbide usually is in the range of about 20–125 $\mu$m. Of course, grain sizes greater than 125 $\mu$m also are acceptable. In embodiments of the invention, the average particle size is indicate by a Fisher Sub-Sieve Size (hereinafter "FSSS") value. An FSSS value of a powder may be obtained by the method as set forth in ASTM B330-88. An FSSS value indicates that a major portion of the measured particles falls in the range of that value.

Carburized tungsten carbide is a type of tungsten carbide which is different from macro-crystalline tungsten carbide, cast tungsten carbide, and cemented or sintered tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or a infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of WC, with a total carbon content in the range of about 6.08% to about 6.18% by weight.

In some embodiments, the large-grain tungsten carbide used has the following typical chemical composition as shown in Table 1.

TABLE 1

Typical Composition of Large-Grain Tungsten Carbide

| COMPONENT | WEIGHT PERCENT |
|---|---|
| WC | Min. 99.9% |
| Total Carbon | 6.14% |
| Free Carbon | 0.03% |
| Al | <10 ppm |
| Ca | <10 ppm |
| Co | <30 ppm |
| Cr | <80 ppm |
| Cu | <5 ppm |
| Fe | <120 ppm |
| Mo | <20 ppm |
| Na | <10 ppm |
| Ni | <60 ppm |
| Si | <25 ppm |
| S | <20 ppm |
| O | <40 ppm |

Typical particle size distribution of the carburized tungsten carbide measured by screen analysis is shown in Table 2.

TABLE 2

Typical Normal Particle Size Distribution of Large-Grain Tungsten Carbide

| MICRON SIZE | MESH SIZE | WEIGHT PERCENT |
|---|---|---|
| >250 μm | +60 | 0 |
| 177 μm–250 μm | +80 to −60 | ~2 |
| 125 μm–177 μm | +120 to −80 | ~7 |
| 88 μm–125 μm | +170 to −120 | ~11 |
| 63 μm–88 μm | +230 to −170 | ~16 |
| 44 μm–63 μm | +325 to −230 | ~23 |
| <44 μm | −325 | ~41 |

It should be noted that any carburized tungsten carbide may be used in embodiments of the invention so long as the grain size of a substantial portion of the carburized tungsten carbide exceeds about 10 μm.

To manufacture a bit body, large-grain carburized tungsten carbide is infiltrated by an infiltration binder. The term "infiltration binder" herein refers to a metal or an alloy used in an infiltration process to cement particles of tungsten carbide together. Suitable metals include all transition metals, main group metals and alloys thereof. For example, copper, nickel, iron, and cobalt may be used as the major constituents in the infiltration binder. Other elements, such as aluminum, manganese, chromium, zinc, tin, silicon, silver, boron, and lead, also may be present in the infiltration binder. In preferred embodiments, copper-based alloys are used as the infiltration binder. For example, one suitable alloy has the following composition: 15% Ni, 24% Mn, 10% Zn, and 51% Cu. Another suitable alloy includes 15% Ni, 20% Zn, and 65% Cu.

In some embodiments, cast tungsten carbide is mixed with large-grain carburized tungsten carbide before infiltration. Cast tungsten carbide is added to facilitate infiltration and to adjust the desired properties of the resulting matrix body. As discussed above, cast tungsten carbide is a eutectic, two-phase $WC/W_2C$ carbide. Generally, cast tungsten carbide has a higher hardness than large-grain carburized tungsten carbide. Therefore, addition of cast tungsten carbide may increase the wear resistance and erosion resistance of the resulting matrix body. Furthermore, addition of coarse cast tungsten carbide also facilitates infiltration of carbide particles by an infiltration binder. This is because, as a general rule, the larger the carbide particles are, the more easily the infiltration binder infiltrates the particles. It is to be noted that cast tungsten carbide may be made in any particle size and distribution. Therefore, cast tungsten carbide with a desired particle size distribution is used to effect better infiltration of large-grain carburized tungsten carbide. In embodiments of the invention, the average particle size of cast tungsten carbide used falls in the range of a few microns to a few hundred microns.

In some embodiments, a mixture is obtained by mixing particles of large-grain carburized tungsten carbide and cast tungsten carbide with nickel powder, and the mixture is then infiltrated by a suitable infiltration binder, such as a copper-based alloy. The nickel powder has an average particle size of about 35–55 μm, although other particle sizes may 20 also be used. The particle size distribution of a typical mixture including particles of large-grain carburized tungsten carbide, cast tungsten carbide, and nickel powder is shown in Table 3.

TABLE 3

Particle Size Distribution of Mixture of Large-Grain Carburized WC, Cast WC, and Ni Powder

| MICRON SIZE | MESH SIZE | NOMINAL | RANGE |
|---|---|---|---|
| >250 μm | +60 | 0 | 0 |
| 177 μm–250 μm | +80 to −60 | 5 | 3–8% |
| 125 μm–177 μm | +120 to −80 | 14 | 11–17% |
| 88 μm–125 μm | +170 to −120 | 14 | 11–17% |
| 63 μm–88 μm | +230 to −170 | 17 | 13–21% |
| 44 μm–63 μm | +325 to −230 | 19 | 13–24% |
| <44 μm | −325 | 31 | 28–36% |

The mixture includes preferably at least 60% by weight of the total tungsten carbide (i.e., large-grain carburized WC and cast tungsten carbide). Although the total tungsten carbide may be used in an amount less than 60% by weight, such matrix bodies may not possess the desired physical properties to yield optimal performance.

Large-grain carburized tungsten carbide preferably is present in an amount ranging from about 50% to about 80% by weight, although less large-grain carburized tungsten carbide also is acceptable. The more preferred range is from about 60% to 70% by weight.

A preferred range for cast tungsten carbide is about 10% to 40% by weight. A more preferred range for cast tungsten carbide is from about 25% to 35% by weight.

The nickel powder is present as the balance of the mixture, typically from about 2% to 12% by weight. In addition to nickel, other Group VIIIB metals such as cobalt, iron, and their alloys also may be used. Such metallic addition in the range of about 5% to about 12% may yield higher matrix strength and toughness, as well as higher braze strength.

In a preferred embodiment, a mixture has the following composition: about 62% large-grain carburized tungsten carbide, about 30% cast tungsten carbide, and about 8% nickel. Such matrix body material, after infiltration by a suitable infiltration binder, results in a high-strength matrix body.

The matrix body material in accordance with embodiments of the invention has many applications. Generally, the matrix body material may be used to fabricate the body for any earth-boring bit which holds a cutter or a cutting element in place. Such earth-boring bits include PDC drag bits, diamond coring bits, impregnated diamond bits, etc. These earth-boring bits may be used to drill a wellbore by contacting the bits with an earthen formation.

A PDC drag bit body manufactured according to embodiments of the invention is illustrated in FIG. 1. Referring to FIG. 1, a PDC drag bit body is formed with faces 10 at its lower end. A plurality of recesses or pockets 12 are formed in the faces to receive a plurality of conventional polycrystalline diamond compact cutters 14. The PDC cutters, typically cylindrical in shape, are made from a hard material such as tungsten carbide and have a polycrystalline diamond layer covering the cutting face 13. The PDC cutters are brazed into the pockets after body has been made. Methods of making polycrystalline diamond compacts are known in the art and are disclosed in U.S. Pat. Nos. 3,745,623 and 5,676,496, for example.

Figure 2:
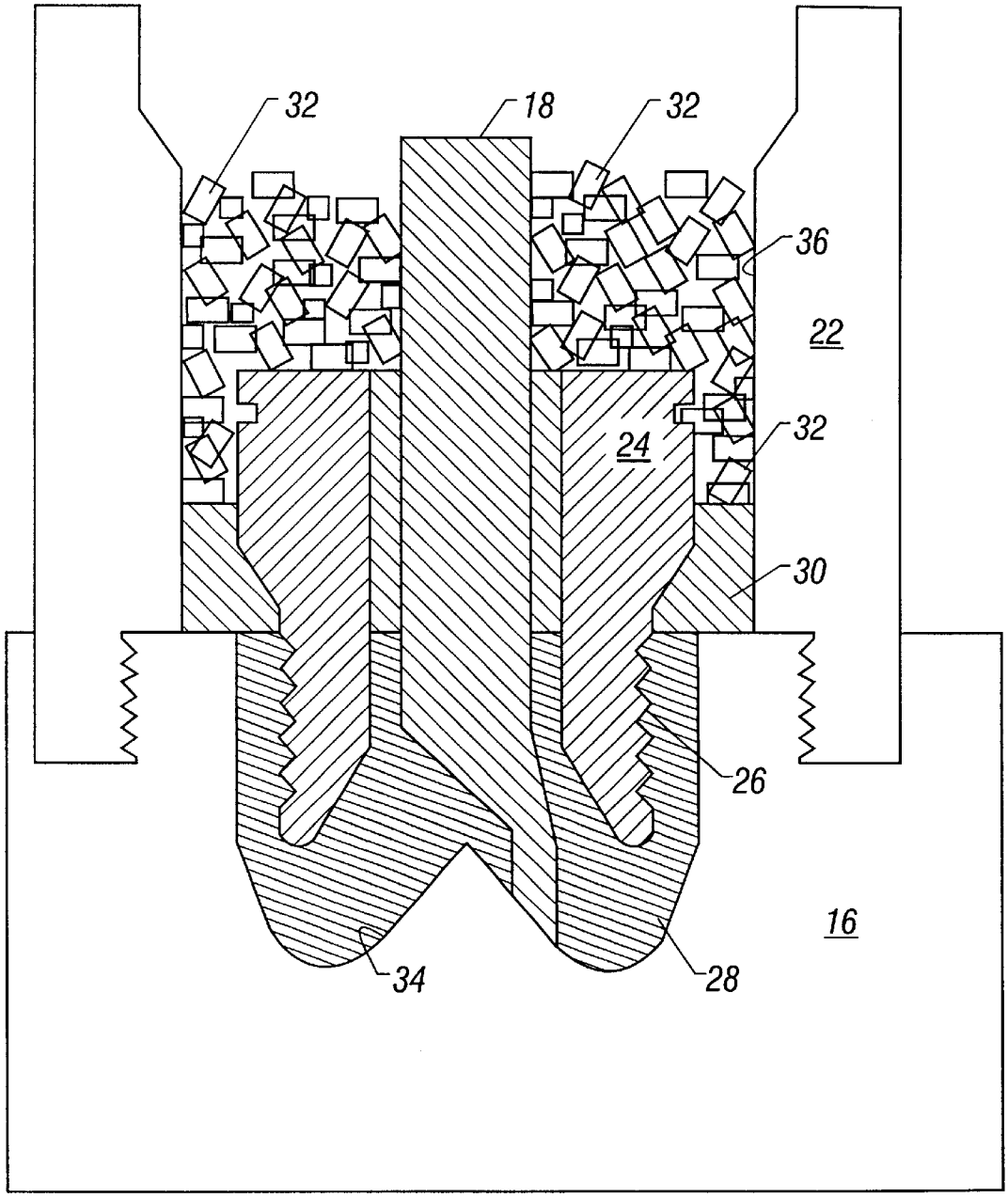
FIG. 2 is a cross-sectional schematic illustration of a mold and materials used to manufacture an earth-boring drill bit body according to another embodiment of the invention.

Referring to FIG. 2, the infiltration process utilizing the matrix formulations according to embodiments of the invention begins with the fabrication of a mold 16, preferably a graphite mold, having the desired bit body shape and cutter configuration. Sand cores 18 form the fluid passage 20 of FIG. 1 in the bit body. A steel blank 24 with grooves 26 is suspended in the mold. A refractory compound 28, e.g., large-grain carburized tungsten carbide mixed with nickel powder, then is introduced into the mold. The grooves 26 in the steel blank enhance the bonding between the blank and the resulting matrix body after infiltration. In some embodiments, the refractory compound further comprises both large-grain carburized tungsten carbide and cast tungsten carbide mixed with nickel powder.

After the refractory compound has been compacted, a machinable and weldable material 30, preferably tungsten metal powder, is introduced into the mold. The machinable powder provides a means to blend the tungsten carbide bit body to the steel blank. A grip on the steel blank, now supported by the refractory compound and machinable material, can be released, and a graphite funnel 22 is attached to the top of the mold. Infiltration binder alloy in the form of small slugs 32 is introduced into the funnel around the steel blank and above the machinable powder. The mold, funnel, and materials contained therein then are placed in a furnace and heated above the melting point of the infiltration binder. The infiltration binder then flows into and wets the machinable and refractory powders by capillary action, thus cementing the powders and the steel blank together. After cooling, the bit body is removed from the mold and is ready for fabrication into a drill bit.

Figure 3:
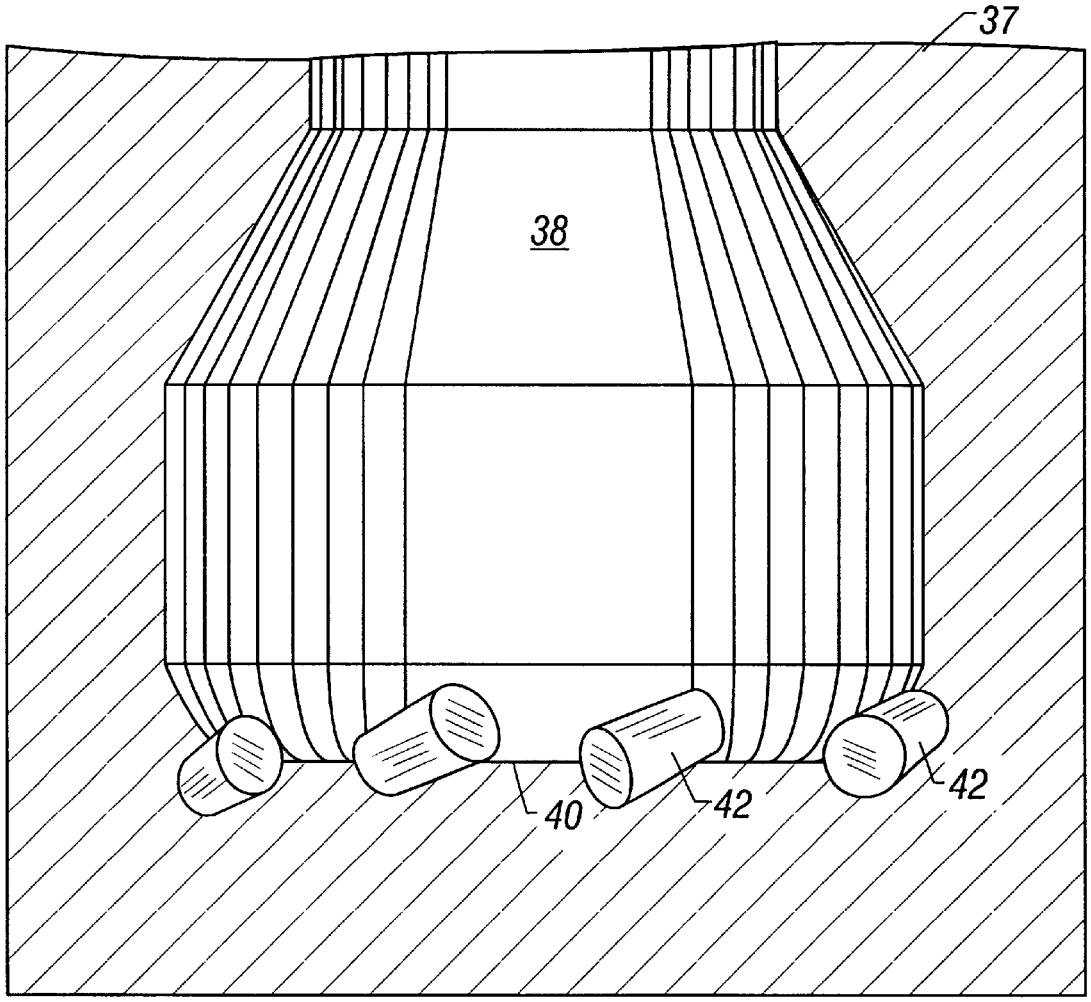
FIG. 3 is a cross-sectional schematic illustration of a mold with graphite plugs used to manufacture PDC drill bit bodies according to one embodiment of the invention.

FIG. 3 illustrates another mold that may be used in embodiments of the invention. Referring to FIG. 3, an exemplary mold 37 used for the formation of recesses or pockets 12 of FIG. 1 has a cavity 38 with a lower end 40. The lower end of the mold has graphite plugs 42. Graphite plugs are placed in the mold to form the recesses or pockets into which the PDC cutters 14 of FIG. 1 will be brazed after the bit body is fabricated. After the refractory compound has been infiltrated and the bit body has cooled, the bit body is removed from the mold, the graphite plugs are shattered, and the pockets are cleaned. The PDC cutters then are brazed into the pockets left by the removal of the plugs.

It should be understood that, in addition to a PDC cutter, other types of cutters also may be used in embodiments of the invention. For example, cutters made of carbide or cemented carbide, particularly cemented tungsten carbide, are suitable for some drilling applications. For other applications, polycrystalline cubic boron nitride cutters may be employed.

The following examples are illustrative of embodiments of the invention, and are not restrictive of the invention as otherwise described herein. In all the following examples, a copper-based alloy with 15% Ni, 24% Mn, 10% Zn, and 51% Cu was used as the infiltration binder or infiltrant.

EXAMPLE 1

Sample 1 comprised a mixture having a composition as follows: about 78% large-grain carburized tungsten, about 16% cast tungsten carbide, and about 6% nickel. The large-grain carburized tungsten carbide had an average FSSS of about 30–50 $\mu$m. The mixture was placed in a graphite mold and heated at about 2150° F. until the infiltrant had infiltrated the powder mass adequately to cement it together. The mass then was allowed to cool.

EXAMPLE 2

Sample 2 comprised a mixture with the following composition: about 94% large-grain carburized tungsten carbide and about 6% nickel. No cast tungsten carbide was added to the mixture. The large-grain carburized tungsten carbide had an average FSSS of about 30–50 $\mu$m. This mixture was placed in a graphite mold and heated at about 2150° F. until the infiltrant had infiltrated the powder mass adequately to cement it together. The mass then was allowed to cool.

EXAMPLE 3

Sample 3 included a mixture that had the following composition: about 78% large-grain carburized tungsten carbide, about 16% cast tungsten carbide, and about 6% nickel. The average FSSS for the large-grain carburized tungsten carbide was about 20.5 $\mu$m. The mixture was placed in a graphite mold and heated at about 2150° F. until the infiltrant had infiltrated the powder mass adequately so as to cement it together. The mass was then allowed to cool.

EXAMPLE 4

Sample 4 comprised a mixture that had the following composition: about 76% of large-grain carburized tungsten carbide, about 16% cast tungsten carbide, and about 8% nickel. The average FSSS for the large-grain carburized tungsten carbide was about 30–50 $\mu$m. The mixture was placed in a graphite mold and heated at about 2150° F. until the infiltrant had infiltrated the powder mass adequately to cement it together. The mass then was allowed to cool.

EXAMPLE 5

Sample 5 comprised a mixture that had the following composition: about 62% of large-grain carburized tungsten carbide, about 30% cast tungsten carbide, and about 8% nickel. The average FSSS for the large-grain carburized tungsten carbide was about 30–50 μm. The mixture was placed in a graphite mold and heated at about 2150° F. until the infiltrant had infiltrated the powder mass adequately to cement it together. The mass then was allowed to cool.

EXAMPLE 6

Sample 6 comprised a mixture that had been used in the prior art. The sample had the following composition: about 76% macro-crystalline tungsten carbide (available from Kennametal, Inc.), about 16% cast tungsten carbide, and about 8% nickel. The mixture was infiltrated in the same manner as described in the above examples.

TEST RESULTS

Tests for impact strength were conducted in accordance with the Charpy V-Notch Impact Test of ASTM Standard SE23. Tests for transverse rupture strength were conducted according to a procedure where a cylindrical pin of the infiltrated material was placed in a fixture. A three-point bending load then was exerted on the pin until failure. The transverse rupture strength was then calculated based upon the actual load to failure and the dimension of the pin specimen. The test was similar to ASTM V528.

Figure 4A:
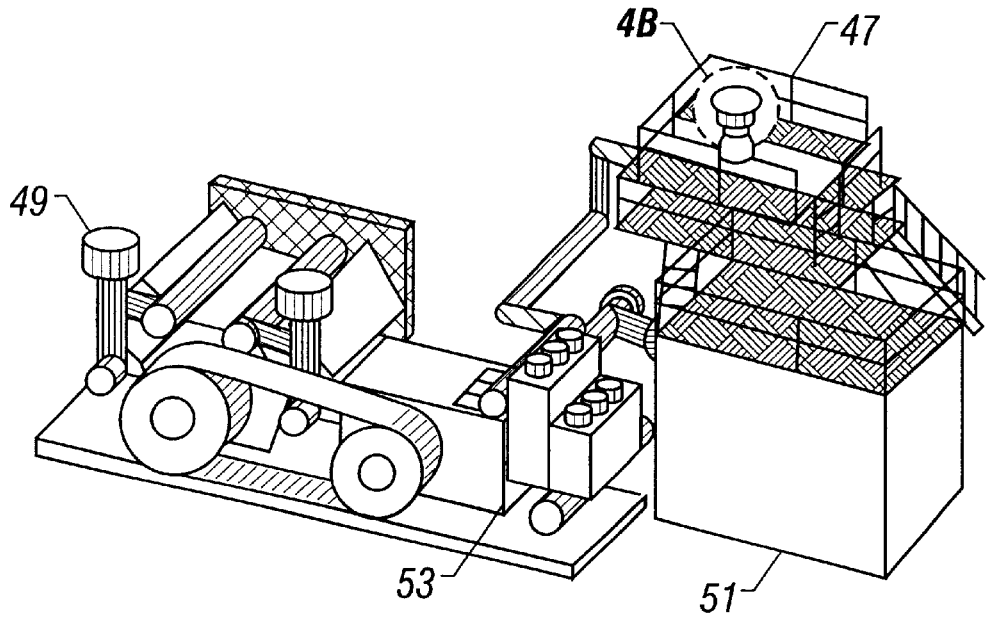
FIG. 4 is a schematic diagram of a mud flow tester used in embodiments of the invention to evaluate erosion resistance.
Figure 4B:
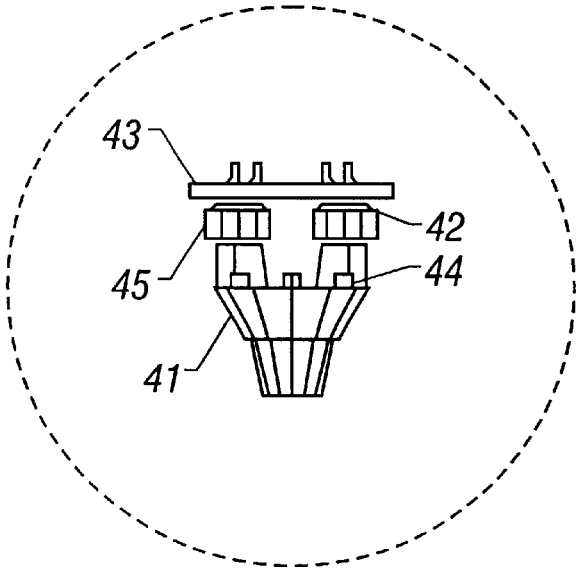

Tests for erosion resistance were conducted in an in-house mud erosion tester, which is illustrated in FIG. 4. Referring to FIG. 4, a pool of drilling mud is stored in mud tanks 51 and compressed by a mud pump 53 driven by a powerful diesel motor 49. The mud (not shown) is injected into twin nozzles 44 of a standard 31-cm. three-cone bit 41 at a velocity of about 107 m/s in each nozzle. A test sample 45 and a reference sample 42 are clamped onto a base plate 43 such that the surface of each sample is perpendicular to the nozzles 44 and spaced at about 2.54 cm. apart. Both samples are subjected to mud erosion for a constant duration of time (usually 30 minutes or 60 minutes) and the resultant wear scar was measured. The size of the wear scar is indicative of the susceptibility of the test sample to erosive wear. The wear resistance of the test sample is normalized against the wear resistance of the reference sample.

Figure 5:
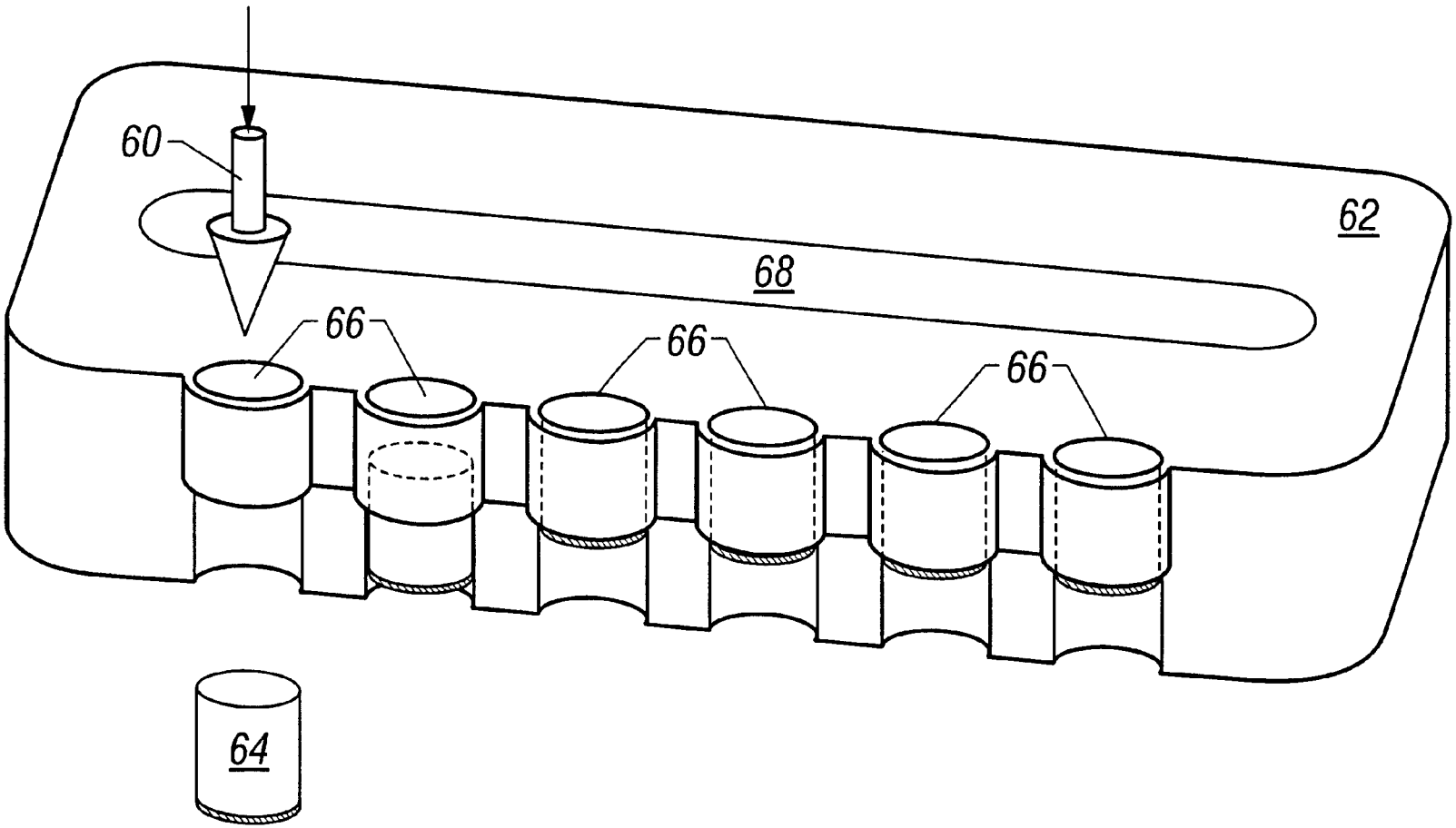
FIG. 5 is a schematic diagram of a braze strength tester used in embodiments of the invention to evaluate braze strength.

Tests for brazing strength were conducted in an in-house braze strength tester, which is illustrated in FIG. 5. Referring to FIG. 5, a rectangular testing coupon 62 is made from a desired matrix body infiltrated by an appropriate binder. Graphite plugs (not shown) are placed in pockets 66 to occupy the position of cutters 64 during infiltration. After infiltration, the testing coupon 62 is cooled and the graphite plugs are removed. The pockets 66 are then cleaned, and cutters 64 are brazed in. The coupon 62 is loaded in a tensile testing machine to measure its braze strength. As a carbide pin 60 descends on a cutter 64 that is brazed in the coupon, a load is applied to the cutter until the cutter is pushed out of the coupon. The breakaway load is measured in pounds and recorded by the machine. This procedure usually is repeated for six cutters in the coupon to obtain an average breakaway load, which is indicative of the braze strength of a matrix body.

Samples No. 1–6 were tested for their braze strength, transverse rupture strength (TRS), toughness, and erosion resistance. Table 4 summarizes the results for each sample.

TABLE 4

Test Results for Samples No. 1–6

| | Sample No.1 | Sample No.2 | Sample No.3 | Sample No.4 | Sample No.5 | Sample No.6 |
|---|---|---|---|---|---|---|
| Large-grain carburized WC | | | | | | |
| Percentage | 78% | 94% | 78% | 76% | 62% | 0% |
| FSSS (μm) | 30–50 | 30–50 | 20 | 30–50 | 30–50 | n/a |
| Cast $WC/W_2C$ | 16% | 0% | 16% | 16% | 30% | 16% |
| Nickel | 6% | 6% | 6% | 8% | 8% | 8% |
| Macro-crystalline WC | 0% | 0% | 0% | 0% | 0% | 76% |
| Braze Strength (lbs) | 20,458 | 17,633 | 16,416 | 22,200 | 20,000 | 16,000 |
| TRS(ksi) | 148 | 165 | 166 | 155 | 170 | 140 |
| Toughness (in-lbs.) | 32.2 | 30 | 30 | 31 | 31 | 30 |
| Erosion Resistance (in/hour) | 0.0014 | 0.0018 | 0.0016 | 0.0015 | 0.0012 | 0.0013 |

The data obtained for Sample No. 4 and Sample No. 6 illustrate the difference between using large-grain carburized tungsten carbide and using macro-crystalline tungsten carbide. Both samples have the same amount of cast tungsten carbide and nickel. While these two samples have similar toughness, Sample No. 4 (which includes large-grain carburized WC) is about 40% higher in braze strength than Sample No. 6 (which includes macrocrystalline WC). Furthermore, about a 10% increase in transverse rupture strength is obtained in Sample No. 4 over Sample No. 6. These improvements in braze strength and transverse rupture strength may be attributable to the use of large-grain carburized tungsten carbide.

The effects of the grain size of carburized tungsten carbide can be seen in Samples No. 1 and No. 3. In both samples, the weight percentage of each component is identical, except that the average grain size in Sample No. 1 is in the range of about 30 to 50 μm, whereas the average grain size in Sample No. 3 is about 20 μm. It is observed that the braze strength of Sample No. 3 is about 20% lower than that of Sample No. 1. Furthermore, the erosion resistance and toughness of Sample No. 3 also are lower than those of Sample No. 1, although the TRS of Sample No. 3 is higher. This may indicate that, within a certain range, the braze strength of a resulting matrix body increases with the average grain size of carburized tungsten carbide. Therefore, larger tungsten carbide particles are preferred in embodiments of the invention.

In addition to the effects of carbide grain size, the amount of nickel used seems to have some influence on the properties of a resulting matrix body. This is indicated by the data obtained from Samples No. 1 and No. 4. The main difference between the two samples is that Sample No. 4 includes 8% nickel, whereas Sample No. 1 includes 6% nickel. It is observed that a higher nickel content results in a higher braze strength, higher toughness, and higher TRS, but a slightly lower erosion resistance. As such, it may be desirable to use more nickel to further optimize the desired properties in some embodiments.

Although large-grain tungsten carbide mixed with nickel power without any cast tungsten carbide may be used in some embodiments, it is more beneficial to include cast tungsten carbide as illustrated by the data from Samples No. 1 and No. 2. Without cast tungsten carbide, the properties of the resulting matrix body are acceptable, except that the erosion resistance is slightly lower than an acceptable value. After adding cast tungsten carbide, the braze strength, toughness and erosion resistance noticeably have increased, while the TRS has experienced a slight decrease.

The data from Samples No. 4 and No. 5 further illustrate the effects of cast tungsten carbide. In both samples, 8% nickel is used. 30% cast tungsten carbide is present in Sample No. 5, whereas 16% cast tungsten carbide in Sample No. 4. It is observed that Sample No. 5 has substantially better erosion resistance and TRS than Sample No. 4. Furthermore, the two samples have similar toughness. While the braze strength of Sample No. 5 is slight lower than that of Sample No. 4, it is still significantly better than the braze strength of other samples. This slight decrease in braze strength is an acceptable compromise for the increased erosion resistance, TRS, and toughness.

As illustrated by the above samples, while large-grain tungsten carbide alone may be acceptable in some embodiments, it is more desirable to add cast tungsten carbide and nickel to obtain a matrix body with enhanced properties. Although it may be difficult to obtain an enhancement in all of the desired properties, it is certainly possibly to obtain a good balance among all the desired properties by adjusting the weight percentage and particle size of the respective components of a matrix composition. However, it should be understood that it is not necessary but only desirable to use both large-grain carburized tungsten carbide and cast tungsten carbide to formulate a matrix composition for the manufacturing of bit bodies. Furthermore, use of nickel powder also is optional, although it has resulted in improvements in the desired properties.

It should be recognized that the beneficial effects of nickel in the resulting matrix body may be realized in a variety of other ways, in addition to use of nickel powder. For example, nickel may be introduced into the resulting matrix body by use of an infiltration alloy with a higher content of nickel than the ones used in the embodiments of the invention. Such methods are considered equivalent to the use of nickel powder.

Figure 6A:
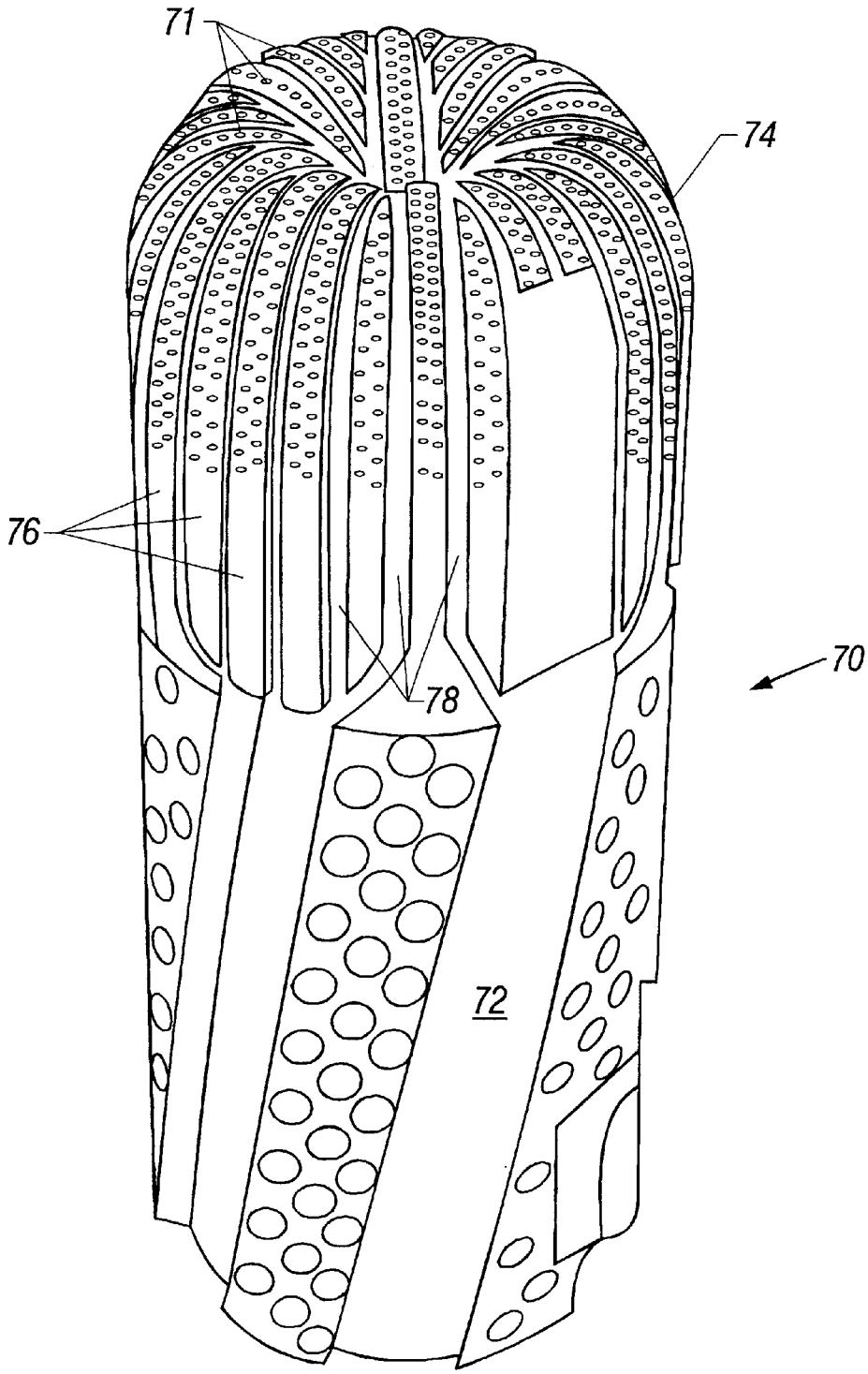
FIG. 6A is a perspective view of one impregnated diamond bit in accordance with an embodiment of the invention.
Figure 6B:
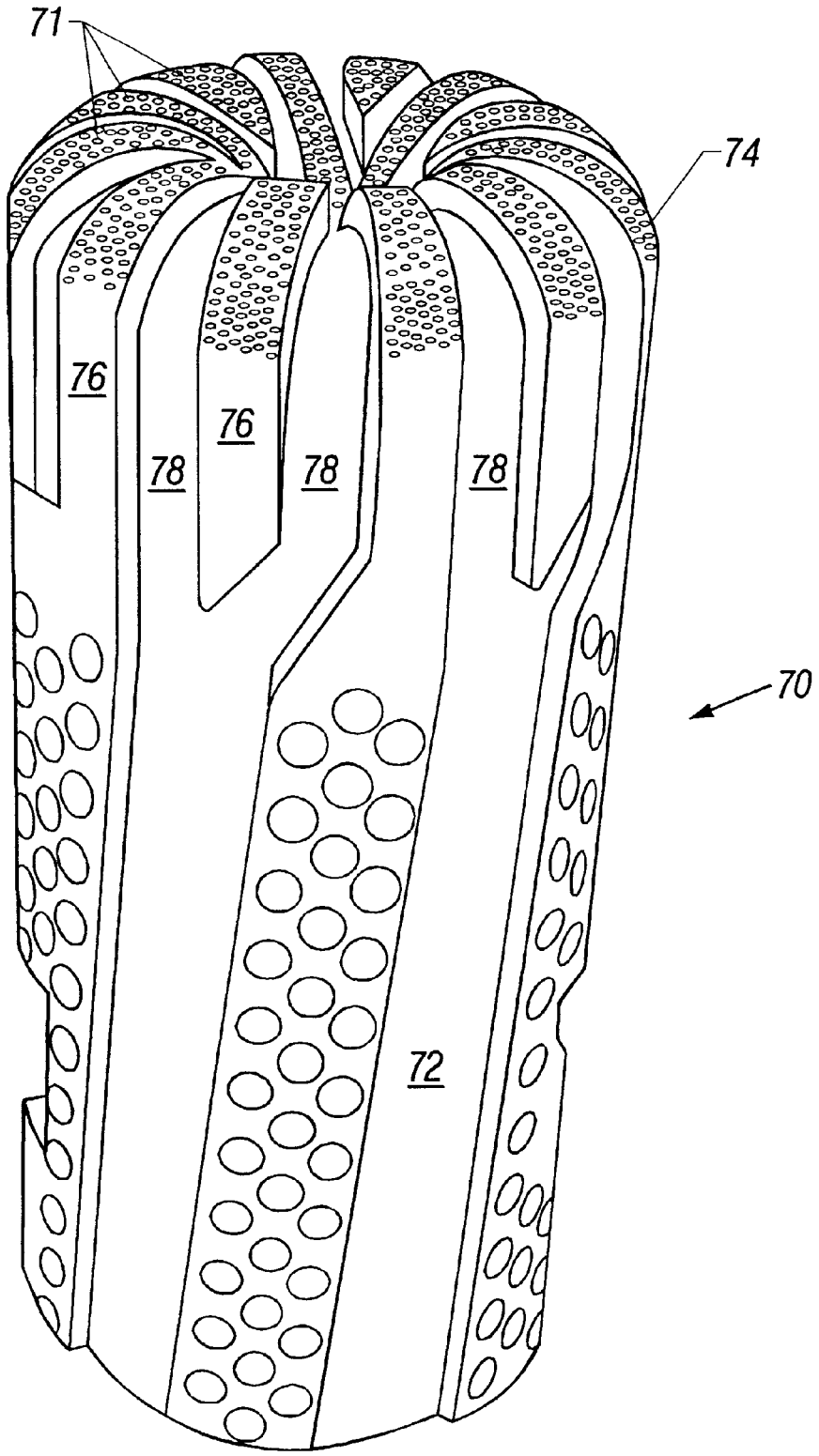
FIG. 6B is a perspective view of another impregnated diamond bit in accordance with an embodiment of the invention.

In addition to a PDC drag bit, an impregnated diamond bit may be manufactured according to embodiments of the invention. FIG. 6 is a perspective view of two kinds of impregnated diamond bits. Referring to FIG. 6A and FIG. 6B, an impregnated diamond bit 70 includes a bit body support 72 and an end face 74. The bit body support 72 has an upper end forming a threaded pin which is to be connected to a drill string (not shown). The end face 74 is adapted for contact with an earthen formation during use. The end face 74 includes a plurality of elevated ribs 76 formed thereon and channels 78 between the ribs 76. The channels 78 function to distribute drilling fluid so that rock cuttings may be removed from the bottom of a wellbore.

The bit body support 72 is preferably formed of a steel core with an outer shell composed of a carbide matrix material. The ribs 76 are formed of the high-strength matrix body according to embodiments of the invention. Embedded in the high-strength matrix body are diamond particles 71, which may be either synthetic or natural. Of course, other suitable superhard materials, such as boron nitride, also may be used.

Methods for manufacturing diamond impregnated bits are known. They generally involve placing diamond or other superhard materials in a suitable mold. The mold then is filled by a powdered matrix material, which is infiltrated by an appropriate infiltration binder. Subsequent finishing operations may include attachment of the fabricated component to a bit body support. In embodiments of the invention, the high-strength matrix material is used to form the ribs. Because the resulting matrix body has high braze strength and good toughness, impact strength and erosion resistance, the impregnated diamond bits may exhibit improved performance in use.

As demonstrated above, the matrix bodies in accordance with embodiments of the invention may have one or more of the following advantages: higher braze strength, improved transverse rupture strength, and comparable toughness and erosion resistance to those materials available in the prior art. These advantages may lead to improved bit bodies for PDC drill bits and other earth-boring devices in terms of longer bit life. Other properties and advantages are apparent to a person of ordinary skill in the art.

While the invention has been disclosed with respect to a limited number of embodiments, numerous variations and modifications therefrom exist. For example, the high-strength matrix body may be manufactured by a sintering process, instead of an infiltration process. Although embodiments of the invention are described with respect to PDC drill bits, the invention is equally applicable to other bits, such as polycrystalline cubic boron nitride bits, tungsten carbide insert rock bits, etc. In addition to tungsten carbide, other ceramic materials or cermet materials may be used, e.g., titanium carbide, chromium carbide, etc. While the combination of large-grain carburized tungsten carbide and cast tungsten carbide is disclosed, other combinations are also possible. For example, large-grain carburized tungsten carbide may be combined with sintered or cemented tungsten carbide. It is also conceivable that a combination of three or more carbides may result in even more enhanced physical properties. It is intended that the appended claims cover all such modifications and variations as fall within the true spirit and scope of the invention.

What is claimed is:

1. A new composition for forming a matrix body, comprising:

agglomerated carburized tungsten carbide; and an infiltration binder including one or more metals or alloys.

2. The new composition of claim 1, further comprising a Group VIIIB metal selected from one of Ni, Co, Fe, and alloys thereof.

3. The new composition of claim 1, further comprising cast tungsten carbide.

4. A high-strength matrix body manufactured by the method, comprising:

providing a composition including agglomerated carburized tungsten carbide; and infiltrating the composition by an infiltration binder including one or more metals or alloys.

5. The high-strength matrix body of claim 4, wherein the composition further includes a Group VIIIB metal selected from one of Ni, Co, Fe and alloys thereof.

6. The high-strength matrix body of claim 5, wherein the composition further includes cast tungsten carbide.

7. The high-strength matrix body of claim 6, wherein the composition includes the agglomerated carburized tungsten carbide and the cast tungsten carbide as combined in an amount of at least 60% by weight before infiltration.

8. The high-strength matrix body of claim 4, wherein the composition includes the agglomerated carburized tungsten carbide in an amount of at least 50% by weight before infiltration.

9. The high-strength matrix body of claim 4, wherein the composition includes the agglomerated carburized tungsten carbide in an amount from about 50% to about 80% by weight before infiltration.

10. The high-strength matrix body of claim 4, wherein the composition includes the agglomerated carburized tungsten carbide in an amount from about 60% to about 70% by weight before infiltration.

11. The high-strength matrix body of claim 6, wherein the composition includes the cast tungsten carbide in an amount from about 10% to about 40% by weight before infiltration.

12. The high-strength matrix body of claim 6, wherein the composition includes the cast tungsten carbide in an amount from about 25% to about 35% by weight before infiltration.

13. The high-strength matrix body of claim 5, wherein the Group VIIIB metal includes Ni.

14. The high-strength matrix body of claim 13, wherein the Ni is in an amount from about 2% to about 12% by weight before infiltration.

15. The high-strength matrix body of claim 13, wherein the Ni is in an amount of about 8% by weight before infiltration.

16. The high-strength matrix body of claim 6, wherein the composition includes, before infiltration, the agglomerated carburized tungsten carbide in an amount of about 62% by weight, the cast tungsten carbide in an amount of about 30% by weight, and Ni in an amount of about 8% by weight.

17. The high-strength matrix body of claim 4, wherein the agglomerated carburized tungsten carbide has an average particle size exceeding approximately 10 $\mu$m before infiltration.

18. The high-strength matrix body of claim 4, wherein the agglomerated carburized tungsten carbide has an average particle size exceeding approximately 20 $\mu$m before infiltration.

19. The high-strength matrix body of claim 4, wherein the agglomerated carburized tungsten carbide has an average particle size exceeding approximately 30 $\mu$m before infiltration.

20. The high-strength matrix body of claim 4, wherein the agglomerated carburized tungsten carbide has an average particle size exceeding approximately 50 $\mu$m before infiltration.

21. An earth-boring bit comprising:

a body formed from a composition including agglomerated carburized tungsten carbide and a Group VIIIB metal selected from one of Ni, Co, Fe, and alloys thereof, the composition infiltrated by an infiltration binder including one or more transition metals or alloys thereof; and a cutter which is fixedly attached to the body.

22. The earth-boring bit of claim 21, wherein the composition further comprises cast tungsten carbide.

23. The earth-boring bit of claim 22, wherein the Group VIIIB metal includes Ni.

24. The earth-boring bit of claim 23, wherein the composition includes, before infiltration, the agglomerated carburized tungsten carbide in an amount of about 62% by weight, the cast tungsten carbide in an amount of about 30% by weight, and the Ni in an amount of about 8% by weight.

25. The earth-boring bit of claim 21, wherein the cutter is formed of carbide.

26. The earth-boring bit of claim 21, wherein the cutter is formed of cemented tungsten carbide.

27. The earth-boring bit of claim 21, wherein the cutter includes a polycrystalline diamond compact.

28. The earth-boring bit of claim 21, wherein the cutter includes a polycrystalline cubic boron nitride compact.

29. A polycrystalline diamond compact bit comprising:

a body with a lower end having a face, the body formed from a composition including agglomerated carburized tungsten carbide and a Group VIIIB metal selected from one of Ni, Co, Fe, and alloys thereof, the composition infiltrated by an infiltration binder including one or more transition metals or alloys thereof;

a plurality of pockets in the face of the body; and a plurality of cutters in the pockets, wherein the cutters include a polycrystalline diamond compact.

30. The polycrystalline diamond compact bit of claim 29, wherein the composition further comprises cast tungsten carbide.

31. The polycrystalline diamond compact bit of claim 30, wherein the Group VIIIB metal includes Ni.

32. The polycrystalline diamond compact bit of claim 31, wherein the composition includes, before infiltration, the agglomerated carburized tungsten carbide in an amount of about 62% by weight, the cast tungsten carbide in an amount of about 30% by weight, and the Ni in an amount of about 8% by weight.

33. An impregnated bit, comprising:

a bit body support;

a matrix body attached to the bit body support, the matrix body formed from a composition including agglomerated carburized tungsten carbide and a Group VIIIB metal selected from one of Ni, Co, Fe, and alloys thereof, the composition infiltrated by an infiltration binder including one or more transition metals or alloys thereof; and a particle of superhard material bonded in the matrix body.

34. A method of making a high-strength matrix body, comprising:

providing a composition including agglomerated carburized tungsten carbide; and infiltrating the composition by an infiltration binder including one or more metals or alloys thereof.

35. The method of claim 34, wherein the composition further includes a Group VIIIB metal selected from one of Ni, Co, Fe, and alloys thereof.

36. The method of claim 35, wherein the composition includes cast tungsten carbide.

37. The method of claim 36, wherein the Group VIIIB metal includes Ni.

38. The method of claim 37, wherein the composition includes, before infiltration, the agglomerated carburized tungsten carbide in an amount of about 62% by weight, the cast tungsten carbide in an amount of about 30% by weight, and the Ni in an amount of about 8% by weight.

39. A method of making an earth-boring bit, comprising:

providing a composition including agglomerated carburized tungsten carbide and a Group VIIIB metal selected from one of Ni, Co, Fe, and alloys thereof;

forming a matrix body from the composition by infiltrating the composition by an infiltration binder including one or more transition metals or alloys thereof; and attaching a cutter fixedly to the matrix body.

40. The method of claim 39, wherein the composition includes cast tungsten carbide.

41. The method of claim 40, wherein the Group VIIIB metal includes Ni.

42. The method of claim 41, wherein the composition includes, before infiltration, the agglomerated carburized tungsten carbide in an amount of about 62% by weight, the cast tungsten carbide in an amount of about 30% by weight, and the Ni in an amount of about 8% by weight.

43. A method of making a polycrystalline diamond compact bit, comprising:

providing a composition including agglomerated carburized tungsten carbide and a Group VIIIB metal selected from one of Ni, Co, Fe, and alloys thereof;

forming a matrix body with a lower end having a face, the body formed from the composition by infiltrating the composition by an infiltration binder including one or more transition metals or alloys thereof;

forming a plurality of pockets in the face of the matrix body; and placing a plurality of cutters in the pockets, wherein the cutters include a polycrystalline diamond compact.

44. The method of claim 43, wherein the composition includes cast tungsten carbide.

45. The method of claim 44, wherein the Group VIIIB metal includes Ni.

46. The method of claim 45, wherein the composition includes, before infiltration, the agglomerated carburized tungsten carbide in an amount of about 62% by weight, the cast tungsten carbide in an amount of about 30% by weight, and the Ni in an amount of about 8% by weight.

47. A method of making an impregnated bit, comprising:

providing a bit body support;

forming a matrix body by infiltrating a composition by an infiltration binder, the composition including agglomerated carburized tungsten carbide and a Group VIIIB metal selected from one of Ni, Co, Fe, and alloys thereof, the infiltration binder including one or more transition metals or alloys thereof; and attaching the matrix body to the bit body support, wherein a particle of superhard material is embedded in the matrix body.

48. A method of drilling a wellbore, comprising:

providing an earth-boring bit having a matrix body and a cutter, the matrix body formed from a composition by infiltrating the composition by an infiltration binder, the composition including agglomerated carburized tungsten carbide and a Group VIIIB metal selected from one of Ni, Co, Fe, and alloys thereof, the infiltration binder including one or more transition metals or alloys thereof; and contacting the earth-boring bit with an earthen formation to drill a wellbore, wherein the cutter is fixedly attached to the matrix body.

* * * * *